US006038532A

United States Patent [19]

Kane et al.

[11] Patent Number: 6,038,532

[45] Date of Patent: Mar. 14, 2000

[54] SIGNAL PROCESSING DEVICE FOR CANCELLING NOISE IN A SIGNAL

[75] Inventors: Joji Kane, Nara; Akira Nohara, Nishinomiya, both of Japan

[73] Assignee: Matsushita Electric Industrial Co., Ltd., Osaka, Japan

[21] Appl. No.: 08/095,179

[22] Filed: Jul. 23, 1993

Related U.S. Application Data

[63] Continuation of application No. 07/637,270, Jan. 3, 1991.

[30] Foreign Application Priority Data

| | | | |
|---|---|---|---|
| Jan. 18, 1990 | [JP] | Japan | 2-008593 |
| Jan. 18, 1990 | [JP] | Japan | 2-008594 |
| Feb. 13, 1990 | [JP] | Japan | 2-033209 |
| Feb. 13, 1990 | [JP] | Japan | 2-033212 |

[51] Int. Cl.[7] ..... G10L 3/02

[52] U.S. Cl. ..... 704/233; 704/226

[58] Field of Search ..... 381/46, 47, 37; 395/2.14, 2.42, 2.35–2.37, 2.17, 2.19; 704/226–228, 205, 233, 208, 210

[56] References Cited

U.S. PATENT DOCUMENTS

| | | | |
|---|---|---|---|
| 4,301,329 | 11/1981 | Taguchi | 381/37 |
| 4,630,305 | 12/1986 | Borth et al. | 395/2.35 |
| 4,912,767 | 3/1990 | Chang | 395/2.42 |
| 5,012,519 | 4/1991 | Adlersberg et al. | 381/47 |

FOREIGN PATENT DOCUMENTS 0 076 687 3/1983 European Pat. Off. .

OTHER PUBLICATIONS

Nabaguchi, H. et al., "Quality Improvement of Synthesized Speech in Noisy Speech Analysis—Synthesis Processing," Electronics and Communications in Japan 64A:9, 1981.

Kroschel, "Methods for Noise Reduction Applied to Speech Input Systems", Proc. on VLSI and Computer Peripherals, vol. 2, IEEE, 1989, pp. 82–87.

Boll, "Suppression of Acoustic Noise in Speech Using Spectral Subtraction", IEEE Trans. on ASSP, vol. ASSP–27, No. 2, Apr., 1979, pp. 113–119.

Nagabuchi et al., "Quality Improvement Of Synthesized Speech In Noisy Speech Analysis–Synthesis Processing", Electronics & Communications in Japan, vol. 64, No. 9, Sep. 1981, pp. 21–30.

Kushner et al., "The Effects Of Subtractive–Type Speech Enhancement/Noise Reduction Algorithms On Parameter Estimation For Improved Recognition And Coding In High Noise Environments", ICASSP 89, May 23–26, 1989, pp. 211–214.

Childers et al., "Co–Channel Speech Separation", ICASSP 87, Apr. 6–9, 1987, pp. 181–184.

Douglas O'Shaughnessy, "Enhancing Speech Degraded By Additive Noise Or Interfering Speakers", IEEE Communication Magazine, vol. 27, No. 2, Feb. 27, 1989, pp. 46–52.

European Search Report on Appl. 91100591.6.

Signal Processing, vol. 15, 15, No. 1, Jul. 1988, pp 43–56, Dal Degan et al and pp 52–53.

Frequenz, vol. 42, Nos. 2–3, Feb.–Mar. 1988, pp 79–84 K. Kroschel and p. 80.

International Conference on Acoustics, Speech & Signal Processing, Apr. 1987, pp 205–208, J.A. Naylor et al. and p. 206.

*Primary Examiner*—David D. Knepper

*Attorney, Agent, or Firm*—Smith, Gambrell & Russell, LLP

[57] ABSTRACT

A frequency analysis system for eliminating noise from an information signal. The system receives an input signal containing noise, and discriminates an information signal from the noise in the input signal. The system then uses the detected noise to cancel noise in the input signal. In one embodiment, the system builds a history of noise information based upon prior detected noise in the signal, and uses this history to predict current noise in the signal.

15 Claims, 12 Drawing Sheets

SIGNAL PROCESSING DEVICE FOR CANCELLING NOISE IN A SIGNAL

This application is a continuation of application Ser. No. 07/637,270, filed Jan. 3, 1991, which application is entirely incorporated herein by reference.

BACKGROUND OF THE INVENTION

1. Field of the Invention

The present invention relates to a signal processing device for effectively eliminating a noise from a signal containing a noise, such as a signal with a mingling of noise.

2. Description of the Related Art

FIG. 1 is a diagram showing the outline of a prior art noise suppression system (Japanese Patent Application Publication No. 63-500543).

In FIG. 1, a voice-plus-noise signal at an input is divided by a channel divider 19 into many selected channels. Then, the gain of these individual pre-processed voice channels is adjusted by a channel gain modifier 21 in response to a modified signal described later so that the gain of the channels exhibiting a low voice-to-noise ratio is reduced. Then, the individual channels comprising the post-processed voice are recombined in a channel combiner 26 to form a noise-suppressed voice signal available at an output.

Also, the individual channels comprising the pre-processed voice are applied to a channel energy estimator 20 which serves to generate energy envelope values for each channel. The post-processed voice is inputted into a channel energy estimator 22. The post-processed estimated channel energy is utilized by a background noise estimator 23 to determine voice/noise.

A channel SNR estimator 24 compares the background noise estimate of the estimator 23 to the channel energy estimate of the estimator 20 to form an SNR estimate. The SNR estimate is utilized to select a specified gain value from a channel gain table comprising experimentally beforehand determined gains. A channel gain controller 25 generates the individual channel gain values of the modified signal in response to the SNR estimate.

However, such prior art noise suppression system adjusts the gain to suppress noise without eliminating noise, so that a sufficiently noise-eliminated signal cannot be obtained.

SUMMARY OF THE INVENTION

It is an object of the present invention to provide a signal processing device for generating a securely noise-eliminated signal by solving the problem of such prior art noise suppression system.

A signal processing device of the present invention comprises:

- frequency analysis means for inputting therein a signal containing noise to perform frequency analysis; and
- signal detection means for detecting a signal portion from the frequency-analyzed;
- noise prediction means for inputting therein the processing means;
- pitch frequency emphasis means for emphasizes the canceled output of the cancel means by the window output of the window generation means; and
- IFFT processing means for IFFT processing the emphasized output of the pitch frequency emphasis means.

DESCRIPTION OF THE PREFERRED EMBODIMENTS

With reference to the drawings, embodiments of the present invention will be explained hereinafter.

Figure 1:
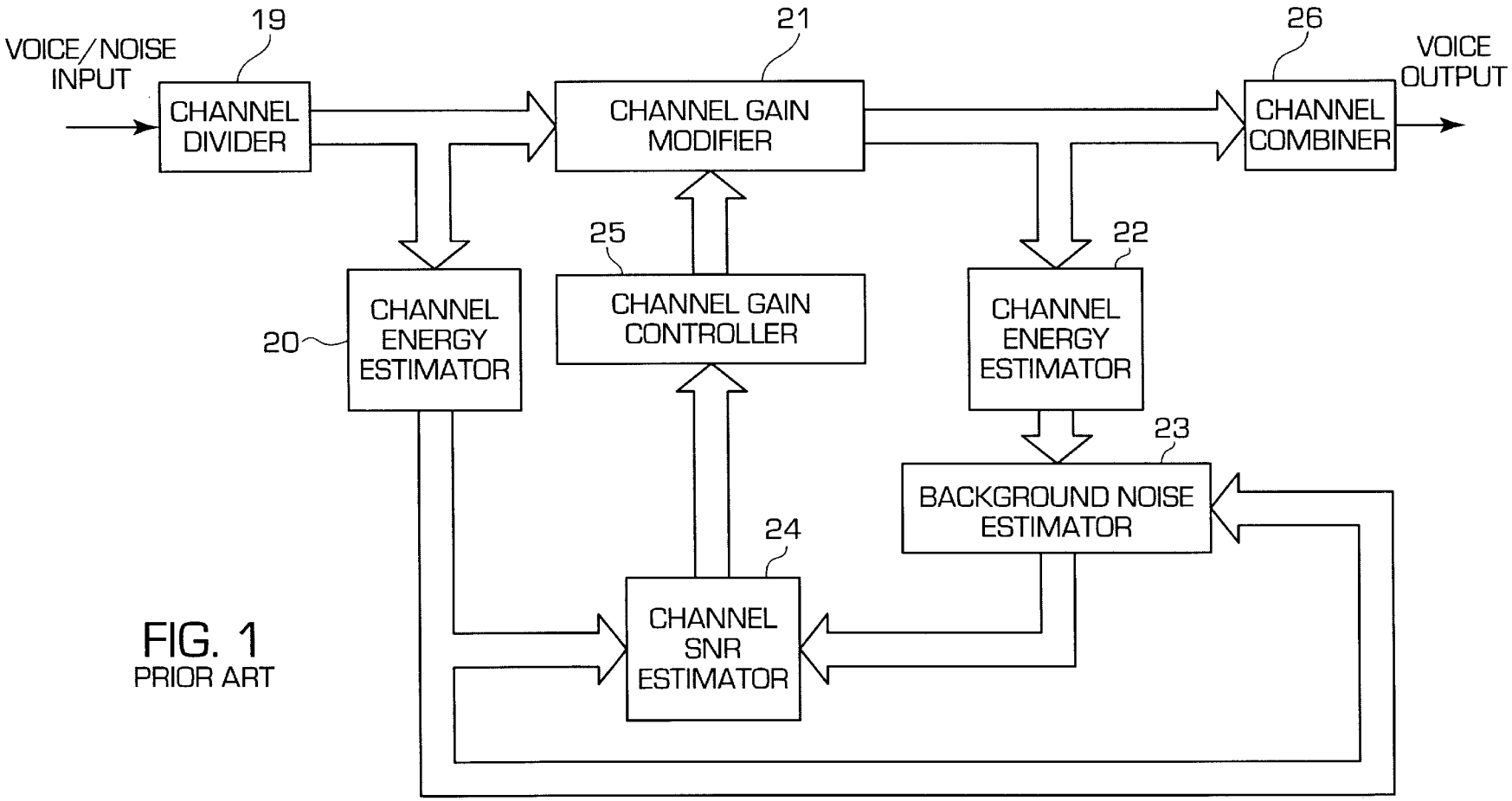
FIG. 1 PRIOR ART
FIG. 1 is a block diagram showing a prior art noise suppression system.
Figure 2:
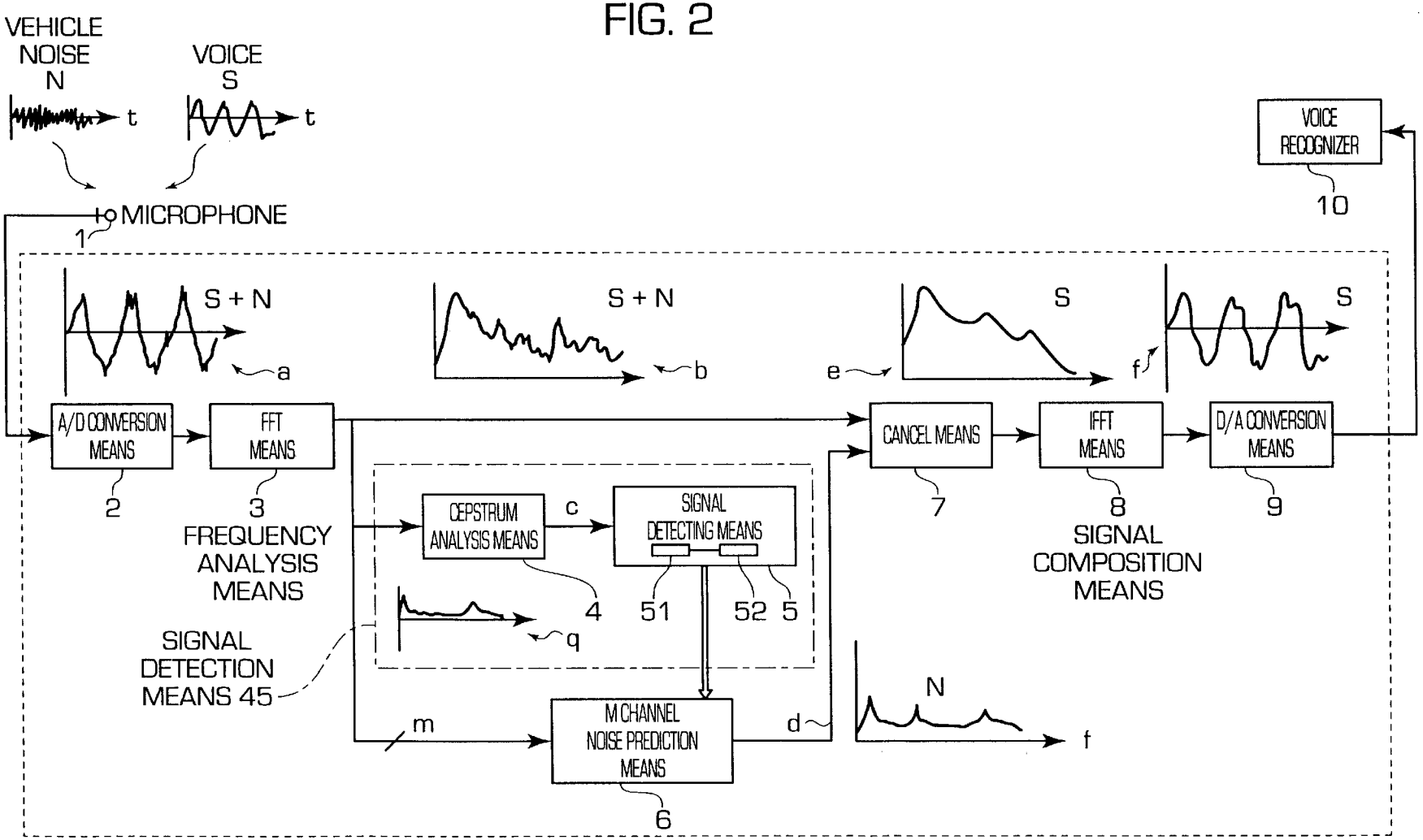
FIG. 2 is a block diagram showing an embodiment of a signal processing device according to the present invention.

FIG. 2 is a block diagram showing an embodiment of a signal processing device according to the present invention.

Into a microphone 1, a noise such as engine sound in addition to voice S is usually entered. Accordingly, the microphone 1 outputs a voice signal with a mingling of noise(S+N).

A/D (Analog-to-Digital) conversion means 2 converts the voice signal with a mingling of noise from an analog signal to a digital signal.

FFT (Fast Fourier Transformation) means 3, as an example of frequency analysis means, performs fast Fourier transformation on the voice signal with a mingling of noise thus converted to a digital signal.

Figure 3A:
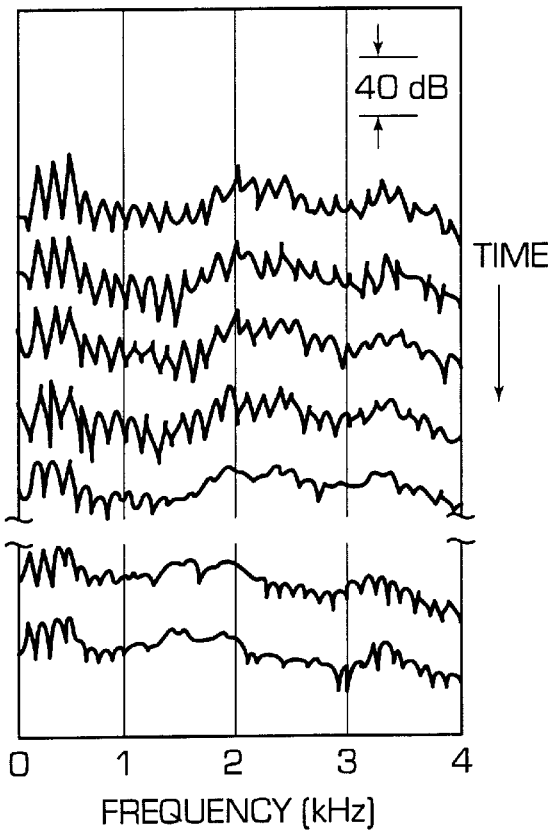
FIG. 3 is graphs of spectrum and cepstrum in the embodiment.
Figure 3B:
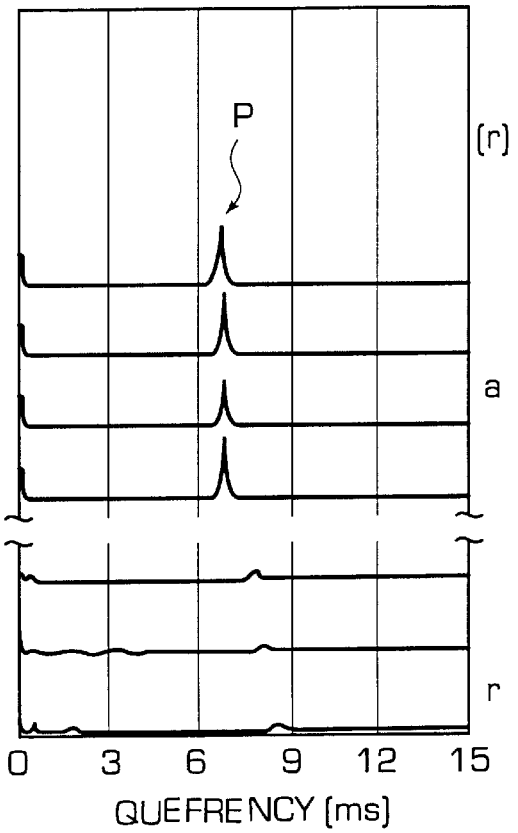

Signal detection means 45 detects a signal portion from the signal with a mingling of noise thus Fourier transformed. For example, the means 45 is provided with a cepstrum analysis means 4 for cepstrum analyzing the Fourier-transformed signal and signal detecting means 5 for detecting the signal portion utilizing the cepstrum thus analyzed. The cepstrum is obtained by inverse Fourier transforming the logarithm of a short-time amplitude spectrum of a waveform as shown in FIG. 3. FIG. 3(*a*) is a short-time spectrum, and FIG. 3(*b*) is a cepstrum thereof. The signal detecting means 5 detects the voice signal portion from a noise portion utilizing the cepstrum. As a method of discriminating the voice signal portion utilizing the cepstrum, for example, a method has been known of detecting the peak of the cepstrum. That is, the method utilizes a peak detection means 51 for detecting the peak of the analyzed cepstrum and signal-noise detection means 52 for discriminating the voice signal on the basis of the peak information thus detected. The P in FIG. 3(*b*) shows the peak, and the portion in which the peak exists is determined to be a voice signal portion. The peak is detected, for example, in such a manner that a specified threshold which has been previously set and the peak value are compared.

Figure 4:
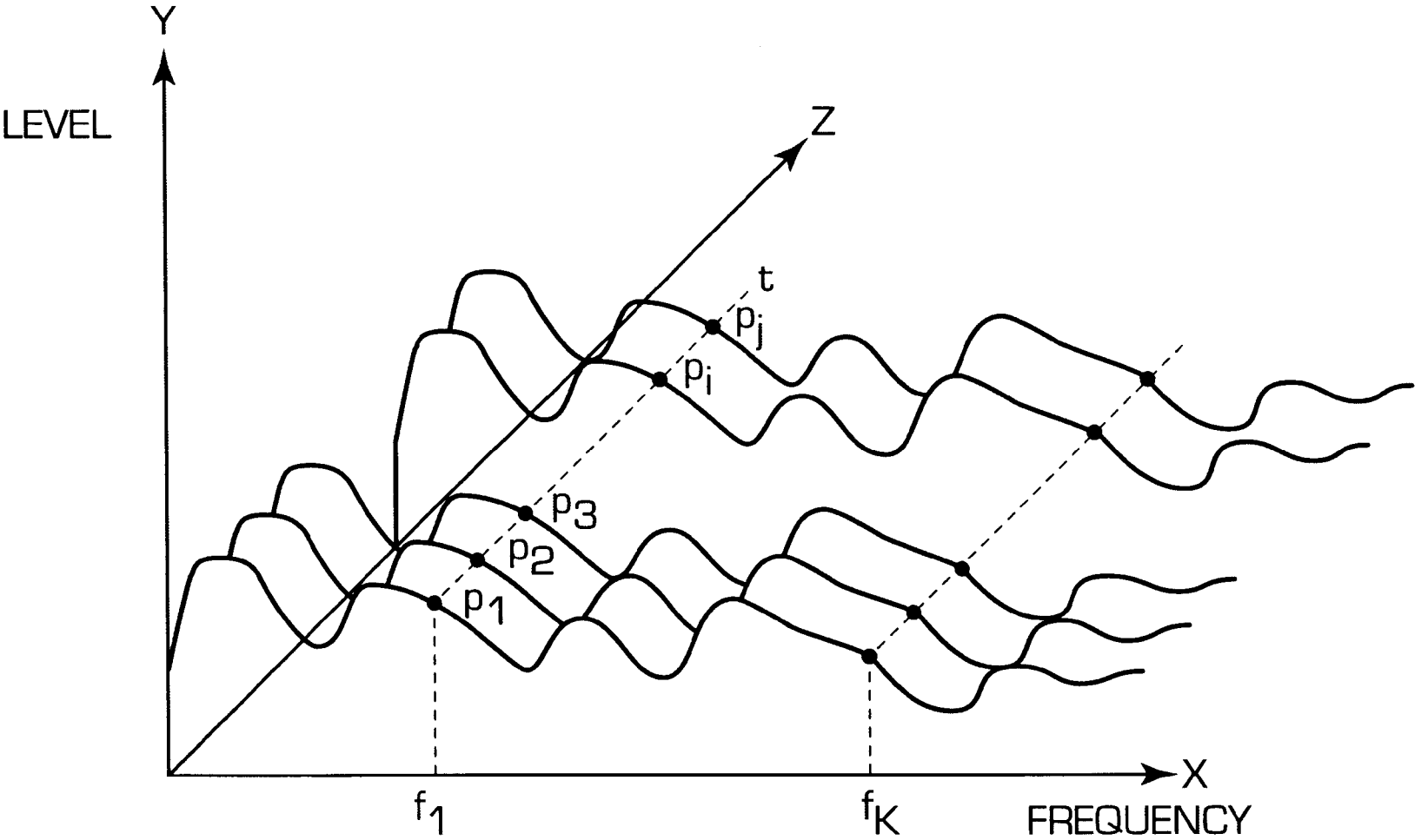
FIG. 4 is a graph illustrating a noise prediction method in the embodiment.

Noise prediction means 6 inputs therein the Fourier-transformed signal with a mingling of noise and predicts the noise in the signal portion on the basis of past noise information. For example, as shown in FIG. 4, the axis X represents frequency, the axis Y represents voice level and the axis Z represents time. The data of p1 and p2 through pi at a frequency f1 are taken to predict pj. For example, the mean value of the noise portions p1 through pi is predicted to be pj. Alternatively, when the voice signal portion continues further, the pj is further multiplied by an attenuation coefficient. In the present embodiment, the noise prediction means 6 predicts the noise in the signal portion utilizing the voice signal portion information detected by the signal detection means 45. For example when the voice signal portion is detected, the means 6 predicts the noise in the signal portion on the basis of the data of the noise portion at the nearest past time when viewed from the point beginning the signal portion. It is also preferable that the noise prediction means 6 utilizes the signal portion (noise portion) information detected by the signal detection means 45 to accumulate the past noise information.

Figure 5A:
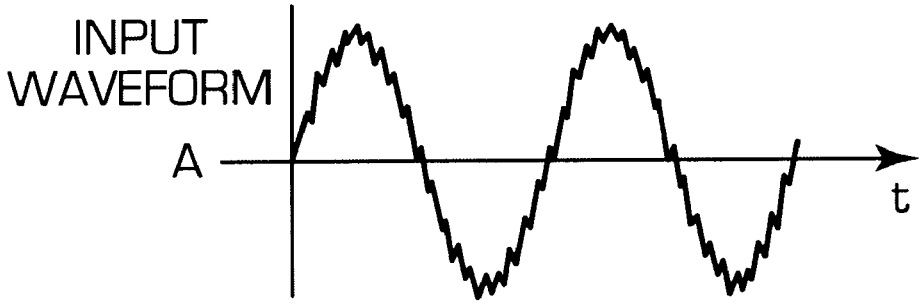
FIG. 5 is a graph illustrating a cancellation method with the time as a basis in the embodiment.
Figure 5B:
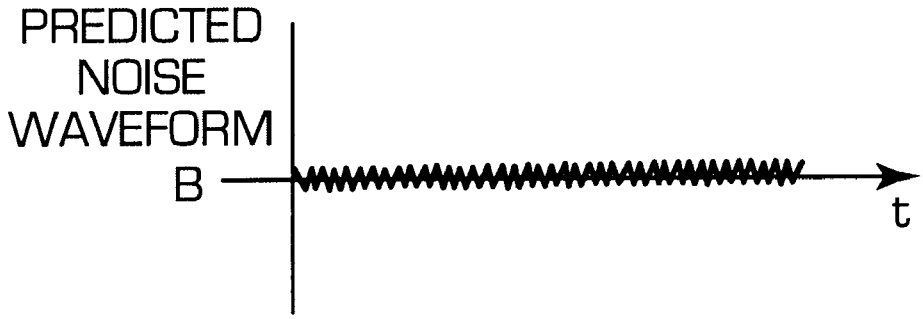
Figure 5C:
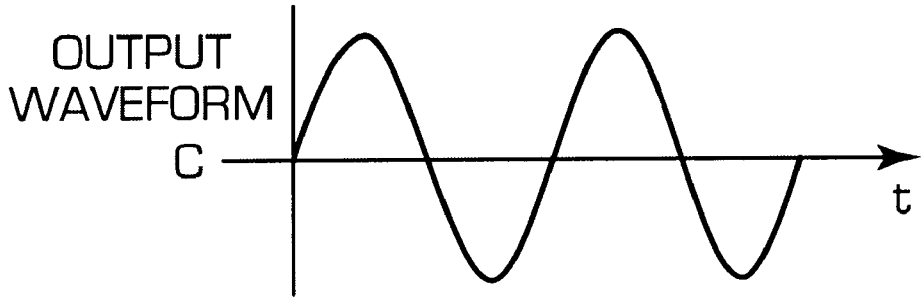
Figure 6A:
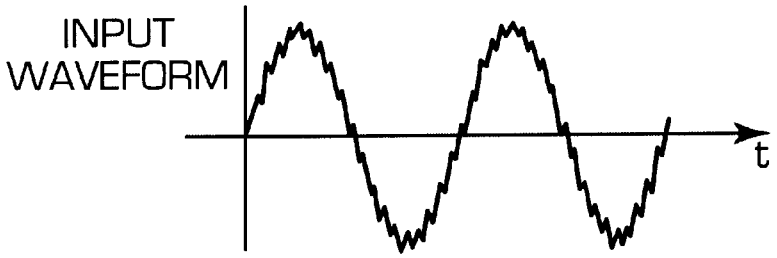
FIG. 6 is a graph illustrating a cancellation method with the frequency as a basis in the embodiment.
Figure 6B:
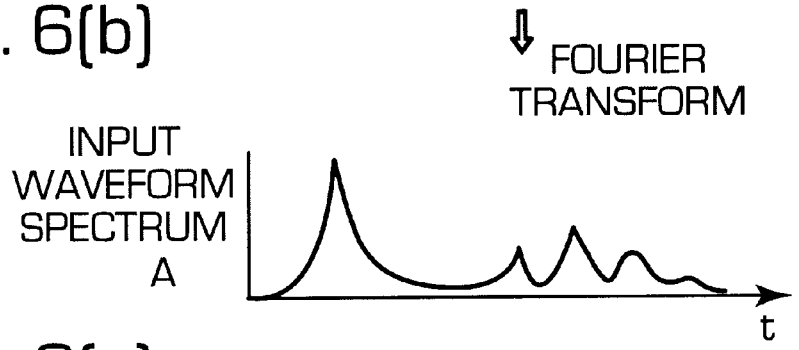
Figure 6C:
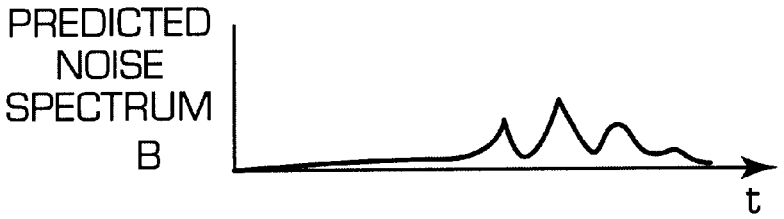
Figure 6D:
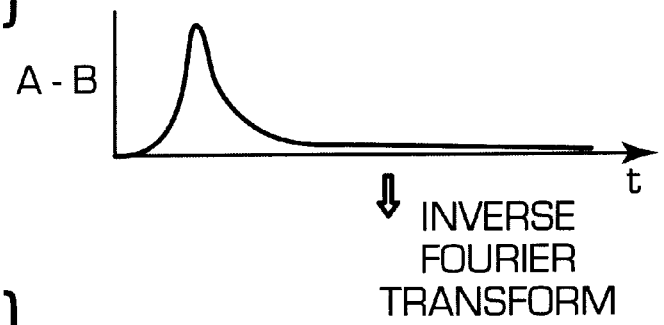
Figure 6E:
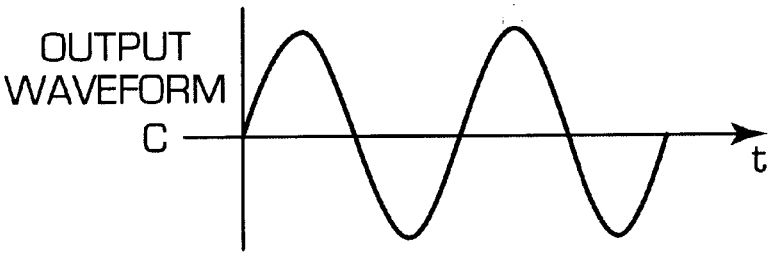

Cancel means 7 subtracts the noise predicted by the noise prediction means 6 from the Fourier-transformed signal having a mingling of noise. For example, the cancellation with the time as a basis is performed in a manner to subtract the predicted noise waveform (b) from the noise-containing voice signal (a) as shown in FIG. 5, thereby allowing only the voice signal to be output (c). Also, as shown in FIG. 6, the cancellation with the frequency as a basis is performed in such a manner that the voice signal containing noise (a) is Fourier transformed (b), then from the signal thus transformed, the predicted noise spectrum (c) is subtracted (d), and the remain is inverse Fourier transformed to obtain a voice signal without noise (e). Of course, the portion without a voice signal can be determined to be only noise, so that a signal obtained by inversing the output of the FFT means 3 is generated, and in the portion without a voice signal, the inversed signal is added directly to the output of the FFT means 3 to eliminate noise completely.

IFFT means 8, as an example of signal composition means, inverse-Fourier transforms the noise-eliminated signal obtained by the cancel means 7.

D/A conversion means 9 converts the noise-eliminated voice signal from a digital signal obtained by the IFFT means 8 to an analog signal. The f in FIG. 2 indicates the noise-eliminated signal being the analog signal.

A voice recognizer 10 recognizes what word the noise-eliminated voice signal thus obtained is.

The operation of the above-described embodiment will be explained hereinafter.

The microphone 1 inputs therein a voice with a mingling of noise and outputs the voice signal with a mingling of noise (S+N) (see FIG. 2, a). The A/D conversion means 2 converts the voice signal with a mingling of noise from an analog signal to a digital signal. The FFT means 3 performs fast Fourier transformation on the voice signal with a mingling of noise thus converted to a digital signal (see FIG. 2, b).

The signal detection means 45 detects a signal portion from the signal with a mingling of noise thus Fourier transformed. For example, the cepstrum analysis means 4 performs cepstrum analysis on the Fourier-transformed signal. Further, the signal detection means 5 detects the voice signal portion utilizing the cepstrum thus analyzed (see FIG. 2, c). For example the means 5 detects the peak of the cepstrum to detect the voice signal.

The noise prediction means 6 inputs therein the Fourier-transformed signal with a mingling of noise, takes the data of p1 and p2 through pi at a frequency f1, and calculates the mean value of the noise portions p1 through pi to determine pj. Also, in the present embodiment, the noise prediction means 6 predicts the noise in the signal portion (see FIG. 2, d), on the basis of the data of the noise portion at the nearest past time when viewed from the point beginning with the signal portion when the signal is detected utilizing the signal portion information detected by the signal detection means 45.

The cancel means 7 subtracts the noise predicted by the noise prediction means 6 from the Fourier-transformed signal having a mingling of noise (see FIG. 2, e).

The IFFT means 8 inverse-Fourier transforms the noise-eliminated voice signal obtained by the cancel means 7.

The D/A conversion means 9 converts the noise-eliminated voice signal being a digital signal obtained by the IFFT means 8 to an analog signal (see FIG. 2, f).

The voice recognizer 10 recognizes what word the noise-eliminated voice signal thus obtained is. Since the voice signal contains no noise, the recognition rate thereof becomes high.

The noise prediction means 6 of the present invention may be such means as to predict the noise component of the signal simply on the basis of the past noise information without utilizing the detected voice signal from the signal detection means 45. For example, the means 6 predicts simply that the past noise continues even in the signal portion.

The present invention also can apply to the processing of other signals with a mingling of noise not limited to that of voice signal.

Further, the present invention, though implemented in software utilizing a computer, may also be implemented utilizing a dedicated hardware circuit.

As described above, the signal processing device according to the present invention detects a signal portion from a frequency-analyzed signal with a mingling of noise, predicts a noise of the signal on the basis of the past noise information, and subtracts the predicted noise from the signal with a mingling of noise, thereby allowing a completely noise-eliminated signal to be generated.

Where noise prediction means 6 uses a voice signal detected by signal detection means 45 as a trigger to predict a noise of the signal portion, the noise can more accurately be predicted, whereby a voice signal from which the noise is more securely eliminated can be generated.

With reference to the drawings, embodiments of another present invention will be explained hereinafter.

Figure 7:
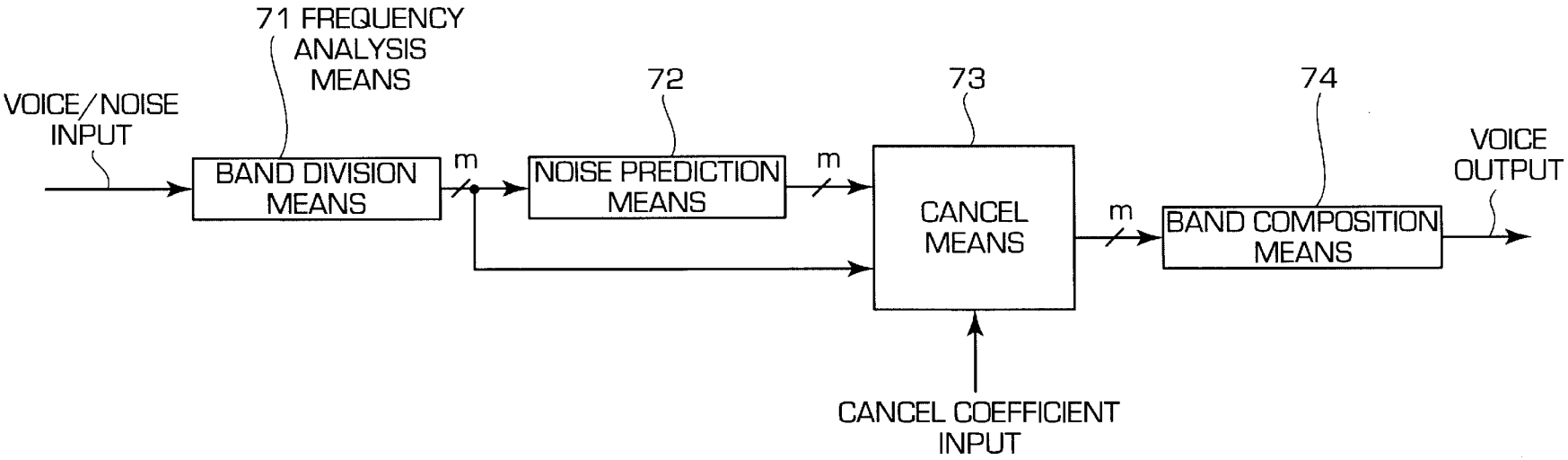
FIG. 7 is a block diagram showing another embodiment of a signal processing device according to the present invention.

FIG. 7 is a block diagram of a signal processing device according to another embodiment of the preset invention. In FIG. 7, the numeral 71 indicates band division means for dividing a voice signal containing noise for each frequency band as an example of frequency analysis means. The numeral 72 refers to noise prediction means for inputting therein the output of the band division means 71 to predict a noise component, of the signal the numeral 73 refers to cancel means for eliminating the noise in a such a manner as described later, and the numeral 74 indicates band composition means for composing a voice as an example of signal composition means for composing a signal.

The above-described means will be explained in detail hereinafter. The band division means 71 is supplied with a voice signal containing noise input, performs band division into m-channel frequency bands, and supplies them to the noise prediction means 72 and the cancel means 73. The noise prediction means 72 predicts noise component for each channel on the basis of the signal input divided into m-channels, and supplies them to the cancel means 73. For example, the noise prediction is performed as described previously and as shown in FIG. 4. The cancel means 73 is supplied with m-channel signals from the band division means 71 and the noise prediction means 72, and cancels noise in a manner to subtract the noise for each channel in response to the cancel coefficient input, and supplies an m-channel voice signal to the band composition means 74. That is, the cancellation is performed by multiplying the predicted noise component by the cancel coefficient. Usually, the cancellation with the time axis as an example of a cancel method is performed as described previously and as shown in FIG. 5. Also, as described previously and as shown in FIG. 6, the cancellation with the frequency as a basis is performed. The band composition means 74 composes the m-channel voice signal supplied from the cancel means 73 to obtain a voice output.

The operation of the signal processing device thus configured in the embodiments of the present invention will be explained hereinafter.

A voice signal containing noise is band divided into m-channel signals by the band division means 71, and a noise component thereof is predicted for each channel by the noise prediction means 72. From the signal band-divided into m-channels by the band division means 71, the noise component supplied for each channel from the noise prediction means 72 is eliminated. The noise elimination ratio at that time is properly set so as to improve articulation for each channel by the cancel coefficient input. For example, articulation is improved in such a manner that, where a voice signal exists, the cancel coefficient is made low even if a noise exists so as not to eliminate much of the noise. Then, the noise-eliminated m-channel signal obtained by the cancel means 73 is composed by the band composition means 73 to obtain a voice output.

As described above, according to the present embodiment, the noise elimination ratio of the cancel means 73 can be properly set for each band by the cancel coefficient input, and the cancel coefficient is accurately selected according to a voice, thereby allowing an articulation noise-suppressed voice output to be obtained.

Figure 8:
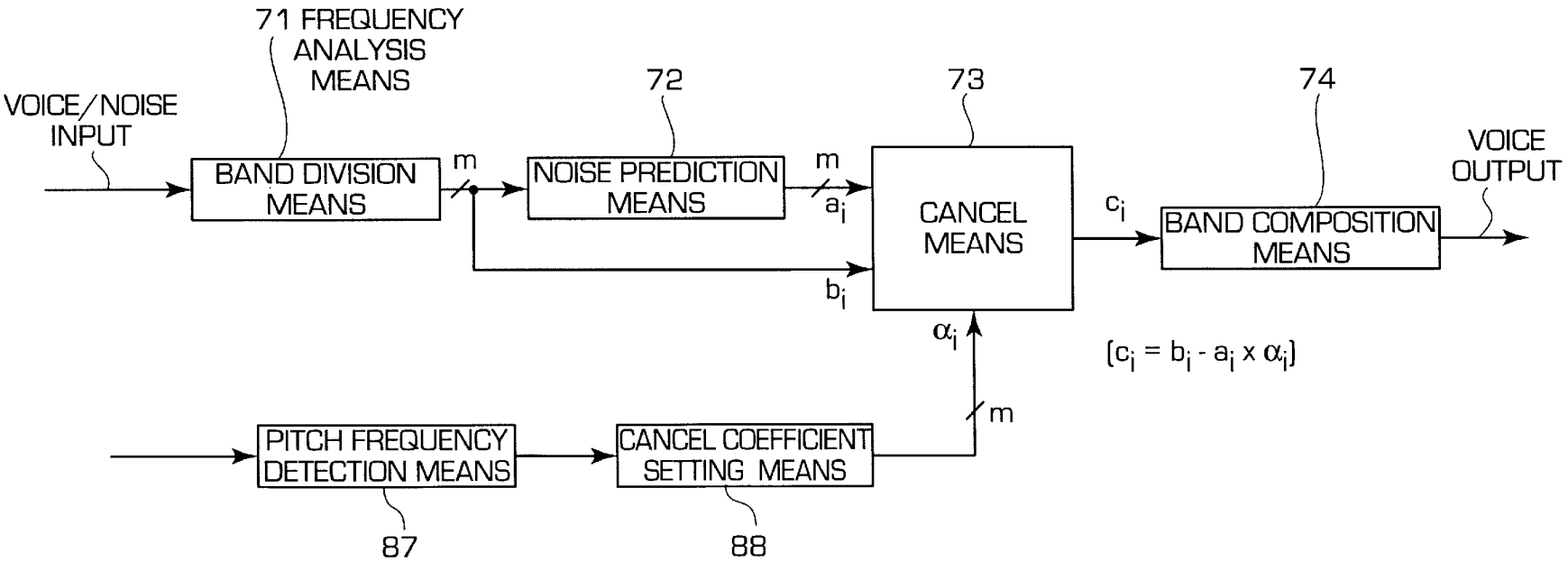
FIG. 8 is a block diagram showing a third embodiment of a signal processing device according to the present invention.

FIG. 8 is a block diagram of a signal processing device according to another embodiment of the present invention.

In FIG. 8, the same numeral is assigned to the same means as that of the embodiment in FIG. 7. That is, the numeral 71 indicates band division means, the numeral 72 indicates noise prediction means, the numeral 73 indicates cancel means, and the numeral 74 does band composition means. Pitch frequency detection means 87 detects a pitch frequency of the voice signal of the input signal and supplies it to channel coefficient setting means 88. The pitch frequency of the voice is determined by various methods as shown in Table 1 and expresses the presence/absence and characteristic of a voice.

Instead of the pitch frequency detection means 87, another means for detecting a voice portion may also be provided. The cancel coefficient setting means 88 is configured in a manner to set a number m of cancel coefficients on the basis of the pitch frequency supplied from the pitch frequency detection means 87 and supply them to the cancel means 73.

The operation of the signal processing device thus configured in the embodiments of the present invention will be explained hereinafter.

A voice signal containing is band-divided into m-channel signals by the band division means 71, and a noise component thereof is predicted for each channel by the noise prediction means 72. From the signal band-divided into m-channels by the band division means 71, the noise component supplied for each channel from the noise

TABLE 1

Figure 9A:
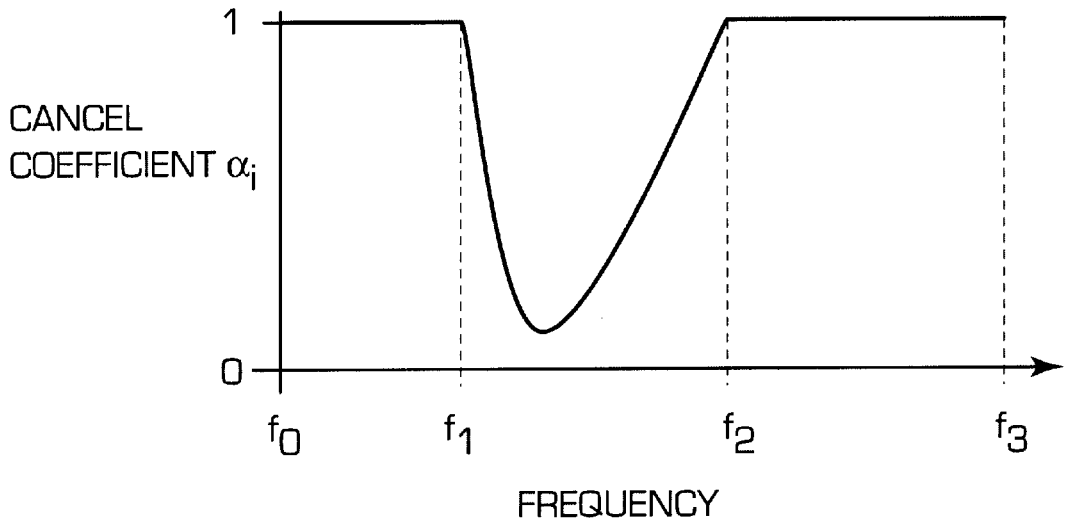
FIGS. 9(*a*) and 9(*b*) is a graph illustrating a cancel coefficient in the third embodiment.
Figure 9B:
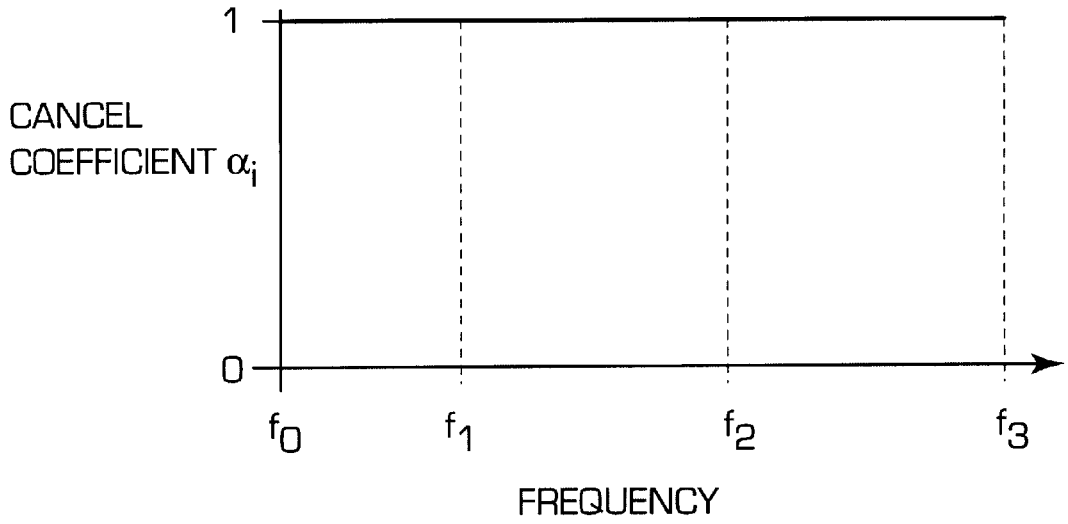

| Classification | Pitch extraction method | Features |
|---|---|---|
| I Waveform Processing | (1) Parallel Processing | Performs decision by majority of pitch periods extracted by 6-class simple waveform peak detector. |
| | (2) Data Reduction | Casts away data other than pitch pulse candidates from waveform data by various logic operations. |
| | (3) Zero Crossing Count | Aims at repeated pattern with respect to number of zero crosses of waveform. |
| II Correlation Processing | (4) Self-correlation | Self-correlation function of voice waveform and center clip allows spectrum to be smoothed and peak clip allows operation to be simplified. |
| | (5,a) Modified Correlation | Self-correlation function of residuals of LPC analysis, and LPF and polarization of residual signal allow operation to be simplified. |
| | (5b) SIFT Algorithm | After down sampling voice waveform, performs LPC analysis and smoothes spectrum by inverse filter. Recovers time accuracy by interpolation of correlation function. |
| | (6) AMDF | Detects periodicity by amplitude mean difference function (AMDF). Also, allows residual signal to be extracted by AMDF. |
| III Spectrum Processing | (7) Cepstrum | Separates envelope and fine structure of spectrum by Fourier transformation of logarithm of power spectrum. |
| | (8) Period Histogram | Determines histogram of higher harmonic of basic frequency on spectrum, and decides pitch by common divisor of higher harmonics. |

prediction means 72 is eliminated. The noise elimination ratio at that time is set for each channel by the cancel coefficient supplied from the cancel coefficient setting means 88. That is, when the predicted noise component represents $a_i$, signal containing noise $b_i$ and cancel coefficient $alpha_i$, the output $c_i$ of the cancel means 73 becomes $(b_i - alpha_1 \times a_i)$. And the cancel coefficient thereof is determined on the basis of the information from the pitch frequency detection means 87. That is, the pitch frequency detection means 87 inputs therein a voice/noise signal and detects the pitch frequency of the voice. The cancel coefficient setting means 88 sets cancel coefficients as shown in FIG. 9. That is, FIG. 9(*a*) shows cancel coefficients at each band, where the $f_0$–$f_3$ indicates the entire band of the voice/noise signal. The $f_0$–$f_3$ is divided into m-channels to set the cancel coefficient. The $f_1$–$f_2$ indicates particularly a band containing a voice signal obtained by utilizing pitch frequency. Thus, in the voice band, the cancel coefficient is made low (close to zero) to eliminate noise as little as possible, thereby causing articulation to be improved. That is because human acoustic sense can hear a voice even though the voice has a little noise. In the non-voice bands $f_0$–$f_1$ and $f_2$–$f_3$, the cancel coefficient is made 1 to remove sufficiently noise. The cancel coefficient in FIG. 9(*b*) is used when it is firmly found that no voice exists and only noise is considered to exist, and is made 1 to remove sufficiently noise. For example, where no vowel continues to exist from view of peak frequency, the signal cannot be determined to be voice signal, so that the signal is determined to be noise. It is preferable that the cancel coefficient in FIGS. 9(*a*) and (*b*) can be properly changed over.

The present invention can apply not only to voice signals but also to other signals processing.

Also, the present invention, though implemented in software utilizing a computer, may also be implemented utilizing a dedicated hardware circuit.

As apparent by the above description, the signal processing device according to the present invention comprises noise prediction means for predicting a noise component, cancel means into which a noise-predicted output of the noise prediction means, a frequency analysis output of frequency analysis means and a cancel coefficient signal are inputted and which cancels the noise component considering the cancel ratio from the frequency analysis output, and signal composition means for composing the canceled output of the cancel means, so that, when the noise component is eliminated from a voice signal containing a noise, the degree of the elimination is properly controlled, thereby allowing the noise to be eliminated and articulation to be improved.

With reference to the drawings, an embodiment of another present invention will be explained.

Figure 10:
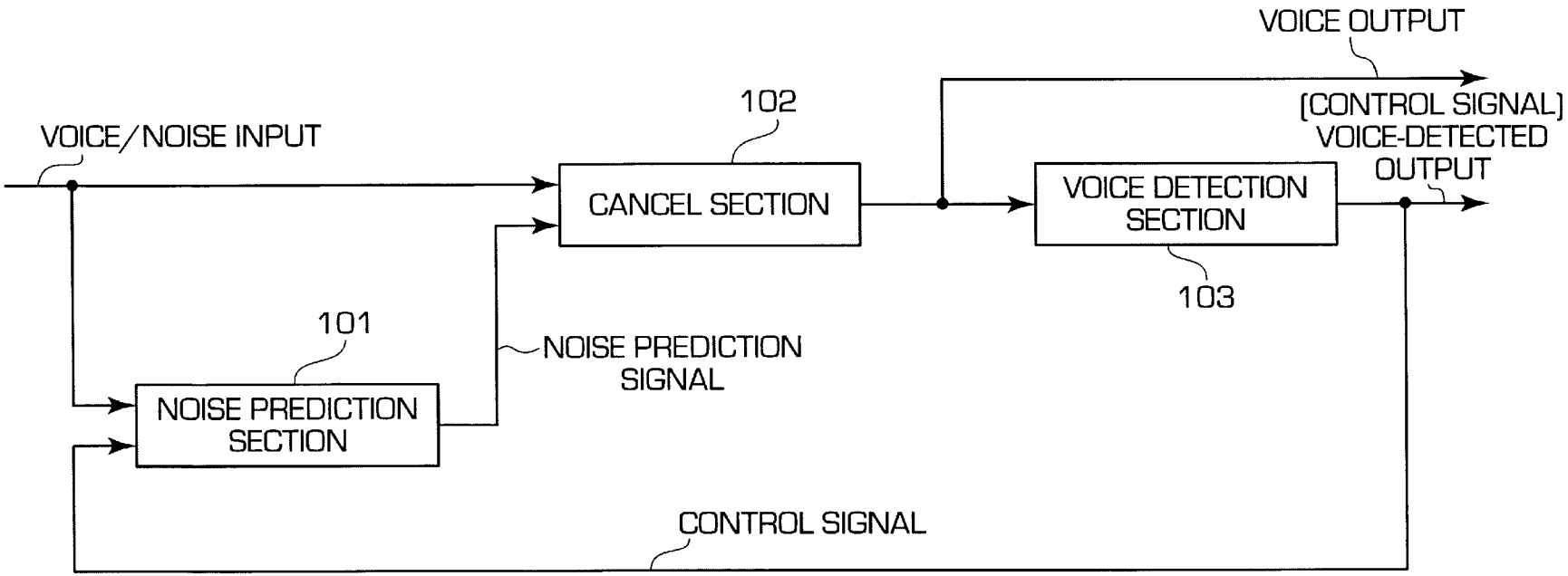
FIG. 10 is a block diagram showing a fourth embodiment of a signal processing device according to the present invention.

FIG. 10 is a block diagram of a signal processing device according to another embodiment of the present invention. The device is configured as shown in FIG. 10. That is, a noise prediction section 101 predicts a noise by a voice signal with noise and by a control signal supplied by a voice detection section 103, and supplies a predicted noise to a cancel section 102. The cancel section 102 eliminates the noise from the voice/noise signal in response to the predicted noise supplied from the noise prediction section 101 to obtain a voice signal output, and supplies the voice signal output to the voice detection section 103. The voice detection section 103 detects the presence/absence of actual voice in the voice signal output to obtain a voice-detected output, and supplies the voice-detected output as a control signal to the noise prediction section 101.

The operation in the above configuration will be explained. A voice overlapping with noise signal is supplied to the cancel section 102 where the noise is eliminated in response to the predicted noise supplied from the noise prediction section 101 to obtain a voice signal output. The voice/noise signal from which the noise is eliminated by the cancel section 102 is supplied to the voice detection section 103 where the presence/absence of voice is detected to obtain a voice-detected output. Thus, the noise prediction section 101 operates such that the section uses as a control signal the voice-detected output indicating the presence/absence of a voice supplied from the voice detection section 103 to predict the noise of the voice/noise signal, and supplies the voice-detected signal to the cancel section 102.

Thus, according to the signal processing device in this embodiment of the present invention, voice detection is performed by the voice signal in which a noise is previously eliminated from a voice/noise input, thereby allowing the presence/absence of a voice to be accurately detected regardless of noise. With such detection, noise prediction can also be performed accurately and the noise is eliminated effectively from the voice/noise input to obtain a clear voice output.

Figure 11:
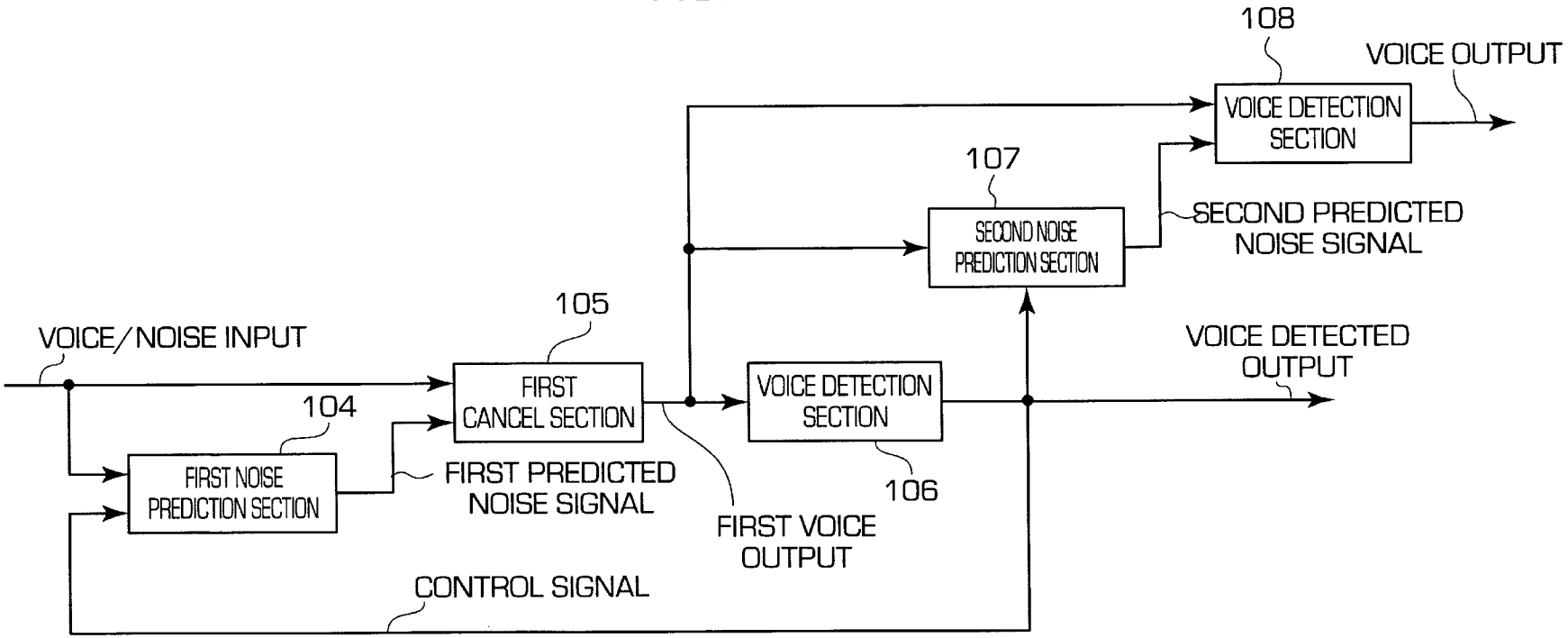
FIG. 11 is a block diagram showing a fifth embodiment of a signal processing device according to the present invention.

With reference to FIG. 11, an embodiment of another present invention will be explained hereinafter.

FIG. 11 is a block diagram of a signal processing device according to another embodiment of the present invention. The device is configured as shown in FIG. 11. That is, a first cancel section 105 eliminates a noise predicted by a first noise prediction section 104 from a voice/noise signal, and supplies the noise-eliminated signal to a voice detection section 106, a second noise prediction section 107 and a second cancel section 108. The voice detection section 106 detects the presence/absence of the signal supplied from the first cancel section 105 to obtain a voice-detected output, and supplies the voice-detected output as a control signal to the first noise prediction section 104 and the second noise prediction section 107. The second cancel section 108 eliminates the noise predicted by the second noise prediction section 107 from the signal supplied from the first cancel section 105 to obtain a voice output. The first noise prediction section 104 and the second noise prediction section 107 both use the control signal from the voice detection section 106 to predict the noise of the voice/noise signal and to predict the noise of the signal supplied from the first cancel section 105, respectively. Then, the second noise prediction section 107 supplies the predicted-result to the second cancel section 108 which in turn makes the canceled-result a voice output.

The operation in the above configuration will be explained. A voice signal overlapping with noise is supplied to the first cancel section 105 where the noise is eliminated in response to a predicted noise supplied from the first noise prediction section 104. A first voice signal output from which the noise has been previously eliminated by the first cancel section 105 is supplied to the second cancel section 108 where the noise is further eliminated accurately in response to a second predicted noise supplied from the second noise prediction section 107 to obtain a voice output. Also, the first voice output from which the noise has been previously eliminated by the first cancel section 105 is supplied to the voice detection section 106 where the presence/absence is detected to obtain a voice-detected output (control signal). Now, the first noise prediction section 104 uses the control signal indicating the presence/absence of a voice supplied from the voice detection section 106 to predict the noise of the voice/noise signal, and supplies a first noise-predicted signal to the first cancel section 105. Further, the second noise prediction section 107 operates such that the section 107 uses similarly the control signal indicating the presence/absence of a voice supplied from the voice detection section 106 to further predict accurately the noise from the first voice output signal from which the noise has been previously eliminated by the first cancel section 105, and supplies the second predicted noise to the second cancel section 108. Thus, the presence/absence of a voice can be accurately detected regardless of noise, and the noise is further predicted accurately and eliminated from the first voice output from which the noise has been previously eliminated, thereby allowing a much lower level and rapidly fluctuated unsteady noise to be eliminated.

With reference to the drawing, another embodiment of the present invention will be explained hereinafter.

Figure 12:
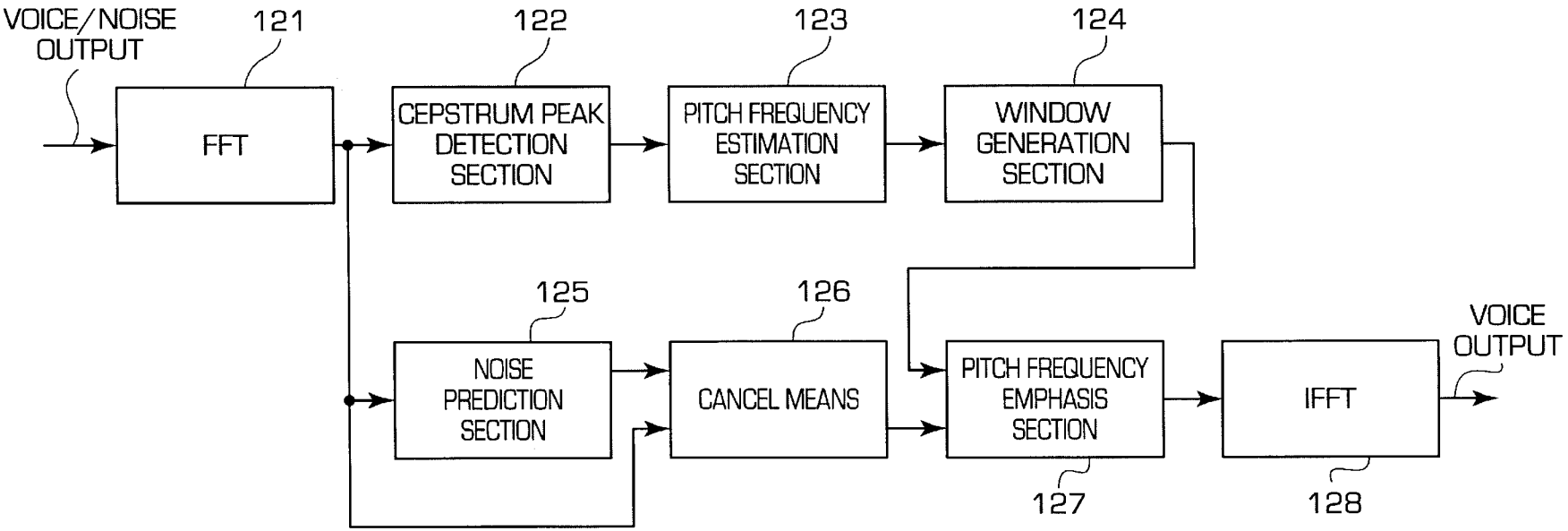
FIG. 12 is a block diagram showing a sixth embodiment of a signal processing device according to the present invention.

FIG. 12 is a block diagram of a signal processing device according to another embodiment of the present invention.

The device is configured as shown in FIG. 12. That is, an FET processing section 121 transforms an input signal to a frequency-region signal, and supplies the transformed signal to a cepstrum peak detection section 122, a noise prediction section 125 and a cancel section 126. The cepstrum peak detection section 122 detects the cepstrum peak from the frequency-region signal obtained from the FET processing section 121, and supplies the detected cepstrum peak to a pitch frequency estimation section 123. The pitch frequency estimate section 123 estimates a pitch frequency from the cepstrum peak and supplies the pitch frequency to an window generation section 124 which in turn generates a window in response to the pitch frequency and supplies the window to a pitch frequency emphasis section 127. The noise prediction section 126 performs noise prediction for the signal supplied from the FET processing section 121 and supplies the noise-predicted signal to the cancel section 126 which in turn processes the signal supplied from the FET processing section 121 according to the predicted noise, and supplies the processed signal to the pitch frequency emphasis section 127. The pitch frequency emphasis section 127 performs pitch-frequency-emphasis-processing by the signals supplied from the window generation section 124 and the cancel section 126, and supplies the processed result to an IFFT section 128 which in turn transforms the signal to a time-region signal for output.

The operation in the above configuration will be explained. First, an input signal to the present device is transformed to a frequency-region signal by the FET processing section 121. The input signal transformed to frequency region is detected for the cepstrum peak thereof by the cepstrum peak detection section 122, and further determined for the pitch frequency thereof by the pitch frequency estimate section 123. Then, on the basis of the determined pitch frequency, the window generation section 124 generates a proper window to perform voice emphasis as the frequency-region data, and supplies the window to the pitch frequency emphasis section 127. The noise prediction section 125 performs noise prediction for the input signal transformed to frequency region, determines the noise component in the frequency region, and supplies the noise component to the cancel section 126. Then, the cancel section 126 eliminates accurately for each frequency component the noise component in the frequency region obtained by the noise prediction section 125, from the input signal transformed to the frequency-region signal supplied from the FET processing section 121, and supplies the noise-eliminated signal to the pitch frequency emphasis section 127. Then, the pitch frequency emphasis section 127 controls the noise-eliminated frequency signal obtained from the cancel section 126 in response to the window to perform voice emphasis obtained from the window generation section 124, performs voice emphasis, and supplies the voice-emphasized signal to the IFFT processing section 128. Then, the IFFT processing section 128 transforms the signal from the pitch frequency emphasis section 127 to a time-region signal for output.

Thus, according to the signal processing device in the embodiment of the present invention, a noise is eliminated from the signal in which a voice overlaps the noise, and the pitch frequency emphasis section is provided to emphasize the voice component, thereby allowing a voice signal with an excellent articulation to be obtained.

Although it is apparently preferable that the window generated by the window generation section 124 in the above embodiment represents a voice harmonic wave structure, the window may be a comb filter and a low-pass filter. It is also apparent that the pitch frequency emphasis section 127 can be simply implemented in a multiplication circuit.

As apparent by the above embodiments, according to the present invention, a device which eliminates a noise by transforming a signal to frequency-region comprises pitch frequency prediction means for predicting a pitch frequency, window generation means for generating a window in response to the pitch frequency, noise prediction means, cancel means for eliminating the noise in response to the output of the noise prediction means, and pitch frequency emphasis means for emphasizing the pitch of the canceled-output of the cancel means using the window of the window generation means, whereby the noise can be eliminated from the signal in which a voice overlaps the noise and further the voice component be emphasized to obtain a voice signal with a high articulation.

It is further understood by those skilled in the art that the foregoing description is a preferred embodiment and that various changes and modifications may be made in the invention without departing from the spirit and scope thereof.

What is claimed is:

1. A signal processing device comprising:

frequency analysis means for performing frequency analysis for an input signal which can contain an information signal and noise, and providing a frequency-analyzed signal;

signal detection means for detecting from said frequency-analyzed signal, a first time period during which an input signal received by said frequency analysis means contains both said information signal and noise and a second time period during which said input signal contains only noise, said signal detection means including cepstrum analysis means for performing cepstrum analysis on said frequency-analyzed signal to obtain a cepstrum peak; and signal detecting means for detecting said first time period based upon a cepstrum analysis by said cepstrum analysis means;

noise prediction means which receives said frequency-analyzed signal for predicting noise in an input signal received by said frequency analysis means during said first time period on the basis of noise in said input signal during said second time period; and cancel means for multiplying said predicted noise by at least one coefficient and subtracting said multiplied predicted noise from said frequency-analyzed signal during said first time period.

2. A signal processing device in accordance with claim 1, wherein said noise prediction means predicts said predicted noise for said frequency-analyzed signal using an occurrence of said first time period detected by said signal detection means as a trigger.

3. A signal processing device in accordance with claim 2, wherein said noise prediction means accumulates noise information during said second time period utilizing the signal detected by said signal detection means.

4. A signal processing device in accordance with claim 1, wherein said signal detecting means further includes:

peak detection means for detecting a cepstrum peak of a cepstrum analyzed by said cepstrum analysis means; and signal noise detection means for discriminating said first time period of said input signal on the basis of a detected peak.

5. A signal processing device in accordance with claim 1, wherein said noise prediction means accumulates noise information during said second time period utilizing the signal detected by said signal detection means.

6. A signal processing device in accordance with claim 1, wherein said frequency analysis means divides said frequency-analyzed signal into a plurality of frequency bands.

7. A signal processing device in accordance with claim 1, wherein said at least one coefficient is an attenuation coefficient.

8. A signal processing device in accordance with claim 7, wherein said attenuation coefficient increases as a duration of said first time period progresses.

9. A signal processing device in accordance with claim 7, wherein said cancel means multiplies said predicted noise by a plurality of cancel coefficients, such that a frequency band of said predicted noise corresponding to each of said plurality of frequency bands of said frequency-analyzed signal is multiplied by an individual cancel coefficient.

10. A signal processing device in accordance with claim 9, further including signal composition means for performing signal composition on said plurality of frequency bands of said frequency-analyzed signal after said noise is subtracted from said plurality of frequency bands of said frequency-analyzed signal by said cancel means to produce an output signal.

11. A signal processing device comprising:

frequency analysis means for performing frequency analysis for an input signal which can contain an information signal and noise, and providing a frequency-analyzed signal and dividing said frequency-analyzed signal into a plurality of frequency bands;

signal detection means for detecting from said frequency-analyzed signal, a first time period during which an input signal received by said frequency analysis means contains both said information signal and noise and a second time period during which said input signal contains only noise, said signal detection means including:

cepstrum analysis means for performing cepstrum analysis on said frequency-analyzed signal to obtain a cepstrum peak; and signal detecting means for detecting said first time period based upon a cepstrum analysis by said cepstrum analysis means;

noise prediction means which receives said frequency-analyzed signal for predicting noise in an input signal received by said frequency analysis means during said first time period on the basis of noise in said input signal during said second time period; and cancel means for i) multiplying said predicted noise by an attenuation coefficient that increases as a duration of said first time period progresses ii) multiplying said predicted noise by a plurality of cancel coefficients, such that a frequency band of said predicted noise corresponding to each of said plurality of frequency bands of said frequency-analyzed signal is multiplied by an individual cancel coefficient, and iii.) subtracting said multiplied predicted noise from said frequency-analyzed signal during said first time period.

12. A signal processing device in accordance with claim 11, wherein said noise prediction means predicts said predicted noise for said frequency-analyzed signal using an occurrence of said first time period detected by said signal detection means as a trigger.

13. A signal processing device in accordance with claim 11, wherein said signal detecting means includes:

peak detection means for detecting a peak of analyzed cepstrum by said cepstrum analysis means; and signal noise detection means for discriminating said first time period of said input signal on the basis of a detected peak.

14. A signal processing device in accordance with claim 11, wherein said noise prediction means accumulates noise information during said second time period.

15. A signal processing device in accordance with claim 11, further including signal composition means for performing signal composition on said plurality of frequency bands of said frequency-analyzed signal after said noise is subtracted from said plurality of frequency bands of said frequency-analyzed signal by said cancel means to produce an output signal.

* * * * *